United States Patent [19]

Manuszak

[11] 4,113,161

[45] Sep. 12, 1978

[54] COMBINATION CARRYING CASE AND STEP UNIT

[76] Inventor: Edward J. Manuszak, 1703 College St., South Bend, Ind. 46628

[21] Appl. No.: 801,730

[22] Filed: May 31, 1977

[51] Int. Cl.[2] ..... B65D 71/00

[52] U.S. Cl. ..... 224/46 R; 182/106; 182/113

[58] Field of Search ..... 224/46 R, 55, 45 R, 224/5 R; 190/42, 57, 51; 182/46, 20, 35, 106, 113, 16; 312/235; 206/216, 527; 297/438, 439

[56] References Cited

U.S. PATENT DOCUMENTS

| | | | |
|---|---|---|---|
| 2,264,744 | 12/1941 | Dunnam | 312/235 R |
| 2,775,499 | 12/1956 | Gleitsman | 182/35 |
| 3,346,155 | 10/1967 | Oechsle | 224/46 R |
| 3,696,850 | 10/1972 | Rosenblum | 190/42 |
| 3,884,327 | 5/1976 | Zigman | 182/106 |
| 3,892,441 | 7/1975 | Roeshnan | 297/439 |
| 3,912,141 | 10/1975 | Appel | 224/46 R |

FOREIGN PATENT DOCUMENTS

| | | | |
|---|---|---|---|
| 619,351 | 3/1949 | United Kingdom | 224/55 |

*Primary Examiner*—Trygve M. Blix
*Assistant Examiner*—Kenneth W. Noland
*Attorney, Agent, or Firm*—Oltsch & Knoblock

[57] ABSTRACT

A combination carrying case and step unit wherein the case is adapted to contain small articles and is rigid to support the weight of a user standing thereon. The case is provided with means having two operative positions which serves in an extended position to be grasped by a user standing thereon and which has a second retracted position convenient for transport of the case from place to place.

2 Claims, 7 Drawing Figures

COMBINATION CARRYING CASE AND STEP UNIT

SUMMARY OF THE INVENTION

This invention relates to improvements in a combination carrying case and step unit.

Many arthritic, handicapped and elderly people have limited use of their knees, hips and other joints, which substantially restricts their freedom of movement. One such restriction is experience when traveling by bus or train which requires a traveler to climb on a step spaced above ground level a distance greater than the normal height of a stair riser. Also, such people commonly have a limited reach an frequently are unable to grasp and retrieve articles in their homes which are mounted upon shelves or in closets at a height or elevation slightly greater than the reach of the individual. No means is now available commercially which will enable a handicapped person to easily climb into a bus or upon a high step without assistance. For this reason, many persons, not otherwise handicapped, who desire to travel are unable to do so. Likewise, few homes or apartments are provided with small stepladders or other means which a handicapped person can use to reach articles stored at locations above the reach of the individual, or to assist such persons to climb upon a chair to enable them to reach elevated articles.

It is the primary object of this invention to provide means which will enable handicapped persons to board and dismount from a bus or train without assistance and without discomfort, and to reach articles in storage positions above the level which can be reached by or to which a handicapped person has normal or unaided access.

A further object is to provide a strong, light weight unit which can be conveniently carried and which can be used both as a step and as a receptacle for small articles.

A further object is to provide a carrying case strong enough for a person to stand upon and provided with means readily convenient for carrying the same, for lowering the same to serve as a step, and for lifting the same from a step-forming position to a travel position.

Other objects will be apparent from the following specification.

DESCRIPTION OF THE PREFERRED EMBODIMENTS

Figure 1:
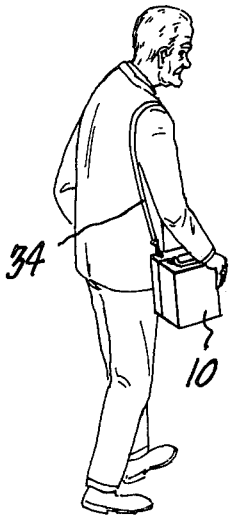
FIG. 1 is a view illustrating an embodiment of the device being used as a carrying case.

Referring to the drawings, and particularly to FIGS. 1-5 thereof which illustrate one embodiment of the invention, the numeral 10 designates a case having a bottom wall 12, side and end walls 14 and a top 16 which is hinged at 18 to one side wall. In the preferred form the top is provided with a flange 20 adapted to form a continuation of the side wall 14 opposite that at which the top is hinged. The case may be formed of any suitable rigid material, such as plastic, wood, composition material or metal, and has its top 16 substantially parallel to its bottom 12 when closed. The case is of a dimension to provide support for the foot or feet of the user who wishes to stand thereon, and is of an elevation when resting on its base of an order comparable to the height of the stair riser and preferably in the range between 7 and 10 inches. The top 10 and preferably also the bottom 12 may have water-resistant contoured tread coverings 22, such as ribbed rubber or synthetic rubber or plastic members, at the outer surfaces thereof. The side and end walls may have any desired shape, color or decorative coating or covering, and the interior of the case may be provided with a lining (not shown).

The case is provided with any suitable latch or clasp means for holding the same closed, such as cooperating latch members 24 and 26, here shown as mounted upon the top flange 20 and upon the side wall 14 opposite the wall at which the cover 16 is hinged, which latch members effectively hold the case in closed position and are readily releasable to permit opening of the case. Any desired type of latch means serving this purpose may be employed. The case also is preferably provided with a hand grip 28 pivoted thereto at 30 to accommodate carrying thereof and adapted to lie against or in contact with a wall of the case when not in use.

Figure 4:
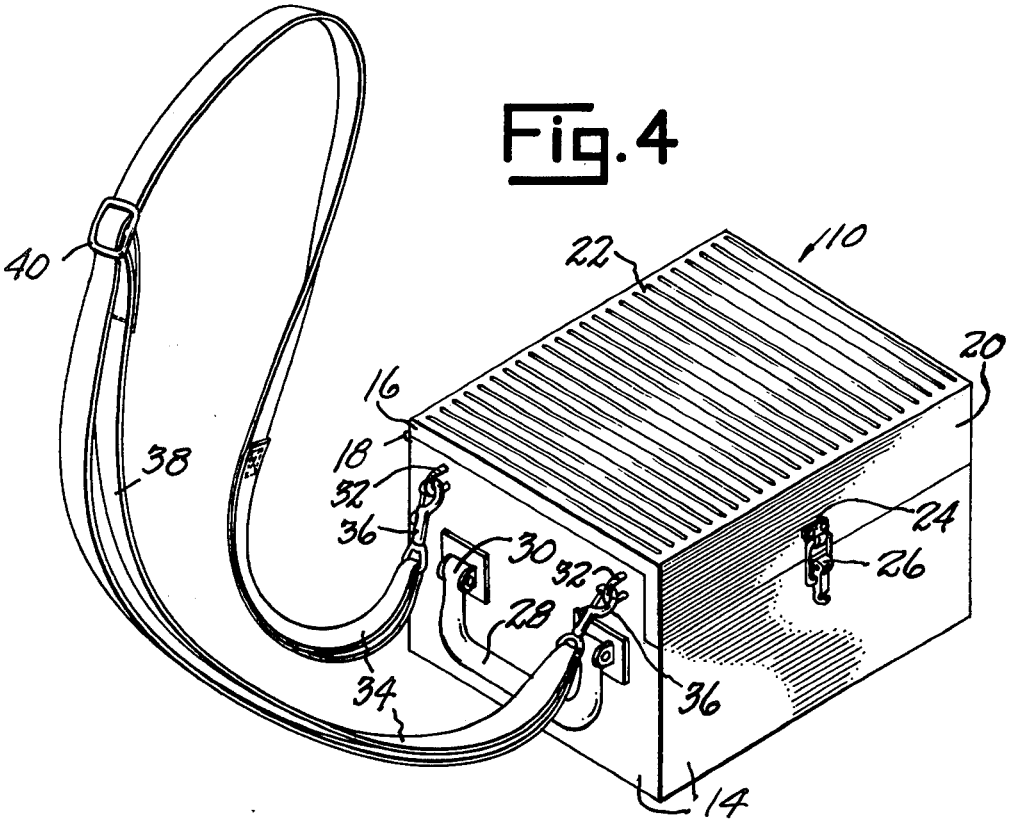
FIG. 4 is a perspective view of one embodiment of the invention.
Figure 5:
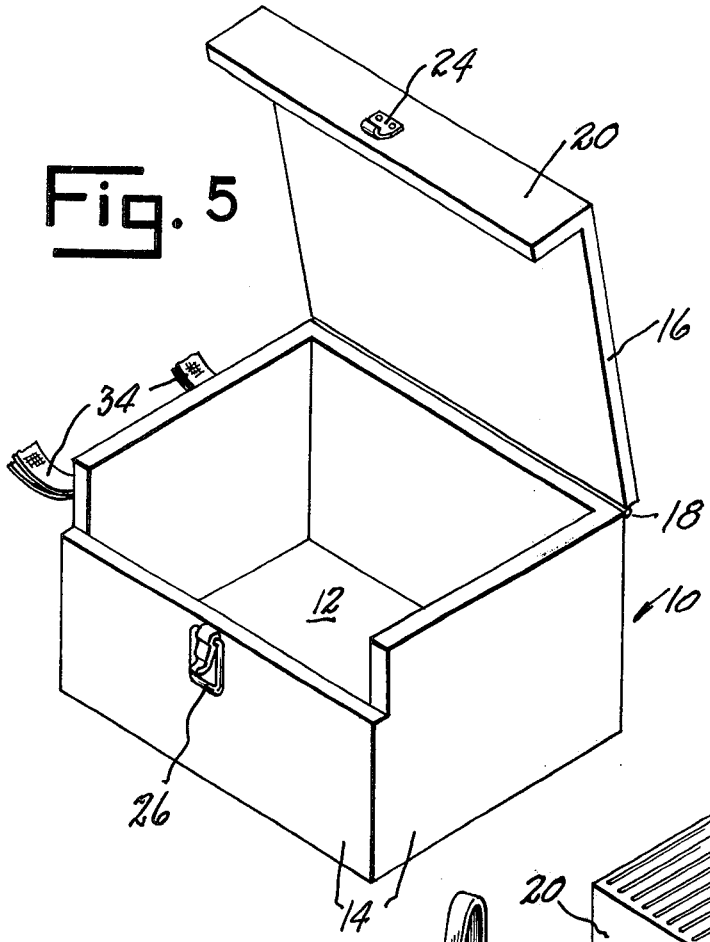
FIG. 5 is a fragmentary perspective view of the device shown in FIG. 14 in open position to serve as a carrying case.

At any suitable wall of the case, and preferably at the wall at which the hand grip 28 is mounted, are secured a pair of projecting U-shaped or staple members 32. As best seen in FIG. 4, staples 32 are preferably positioned in similar or complementary relation at the upper corners of the side wall at which the handle 28 is mounted. An elongated strap 34 mounts at its opposite ends releasable clasps 36 engageable with the staples 32. One end of the strap 34 is preferably characterized by an elongated return bent portion 38 which may be anchored to the strap, as by a buckle 40, and is adapted to provide a looped end of the strap for purposes to be described.

Figure 2:
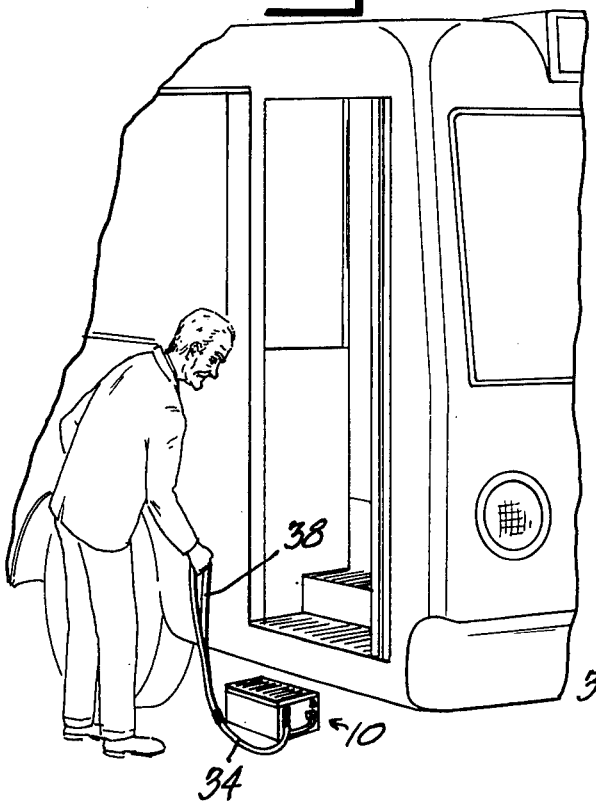
FIG. 2 is a perspective view illustrating the positioning of the device to be used as a step.
Figure 3:
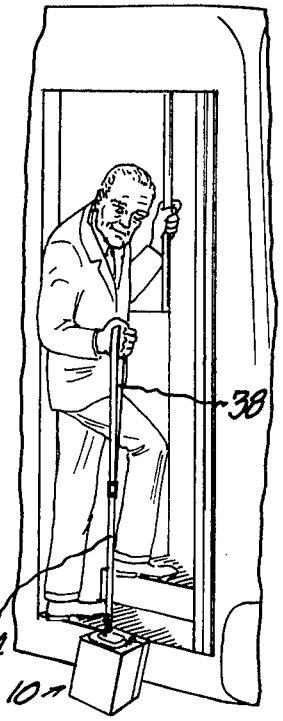
FIG. 3 is a view illustrating the manner in which the device is retrieved after having served as a step.

A typical use of the device by elderly, arthritic or handicapped persons while traveling is illustrated in FIGS. 1, 2 and 3. Thus the case may receive and retain small personal articles required by the user while it is carried in any comfortable or convenient fashion, either by passing the strip 34 over the shoulder of the wearer as illustrated in FIG. 1, or carried by the hand of the wearer gripping the handle 28. When the user reaches a position such as illustrated in FIG. 2 where he requires use of the case as a step to assist him to climb into or out of a vehicle, such as a bus or train, the user releases the clasp 36 at the end of the strap provided with the loop-forming part 38, which action is readily accomplished while he grasps the unit by means of a handle 28. The user can lower the case to the ground or other supporting surface is desired position by desired manipulation of the strap which he can retain by grasping the free end of the strap or after passing the looped end of the strap over his arm. The action of positioning the case to provide the desired step requires minimum bending or stooping by the user and can be accomplished readily without discomfort or pain by arthritic and handicapped persons. The user can then mount the step as an intermediate support during climbing from ground level to a high level, such as a bus step, or in descending from a high level, such as a bus step, to the ground. The user retains the free end of the strap during this ascending or descending movement and has free one arm to assist him in the ascending or descending movement. When the user reaches desired position, as when he has climbed into a bus as illustrated in FIG. 3, a pull upon the strap permits him to retrieve the case so that he can carry it with him, which action again is accomplished with minimum requirement for bending or stooping.

It will be apparent that the usage of the device is not limited to use by travelers, but can be used in a residence as a movable step to permit the user to reach an object located above his normal reach, or to enable him to ascend to and descend from a chair seat if the object desired is located at an elevation requiring him to stand upon a chair seat to reach it. In such instances, the strap or the handle facilitate carrying of the case from a storage position to a use position and return, to position the case for use as a step, and for retrieval of the step from a use position, without requiring a great amount of bending or stooping by the user.

Figure 6:
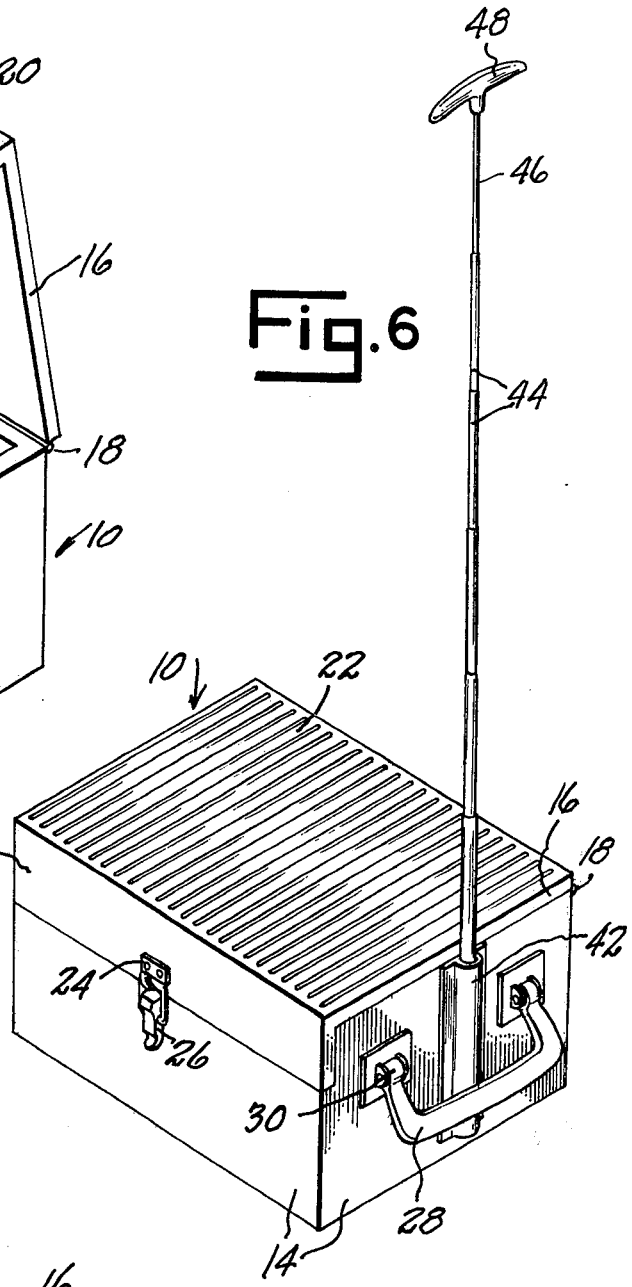
FIG. 6 is a perspective view of another embodiment of the invention.

The provision of a case with a strap as previously described is not essential, and other types of extensible carrying means may be utilized. Thus in FIG. 6 is illustrated a case whose parts bear the same reference numerals as similar parts of the previously described construction bear. In the FIG. 6 construction, a tubular part 42 is fixedly secured to an end wall 14 of the case in vertical position when the case rests upon its bottom and its top panel 16 is positioned horizontally uppermost. The tubular part 42 mounts a multiple-section telescopic tube 44 whose smallest end section 46 carries a hand grip 48. The telescopic tube is preferably of a construction in which the extension of the tube sections thereof relative to the part 42 and to each other is limited so that the telescopic tube parts cannot separate when a pull is applied thereto at the hand grip 48 while the telescopic tube is extended, as illustrated in FIG. 6. The case will be provided with a hand grip member similar to the hand grip member 28 illustrated in FIG. 4 which provides means for carrying it when the telescopic tube is collapsed within the tubular housing 42.

The telescopic tube 44 is of such dimensions and proportions that it is substantially completely housed within the part 42 when collapsed, with only the hand grip 48 projecting therefrom to facilitate gripping of the same to exert the pull required to extend it to a use position. The extended position of the telescopic tube 44 is such that the handle 48 will be positioned conveniently for grasping thereof while the user employs the step to climb or descend, such a position of the handle being at a level which requires minimum bending and stooping of the user during climbing and descending movements. It will be apparent that, when the telescopic tube 44 is extended and grasped at the handle 48, the case can be lowered from transport to use position to form a step, and it can be elevated from step-forming position to transport position by a pull upon the handle.

Figure 7:
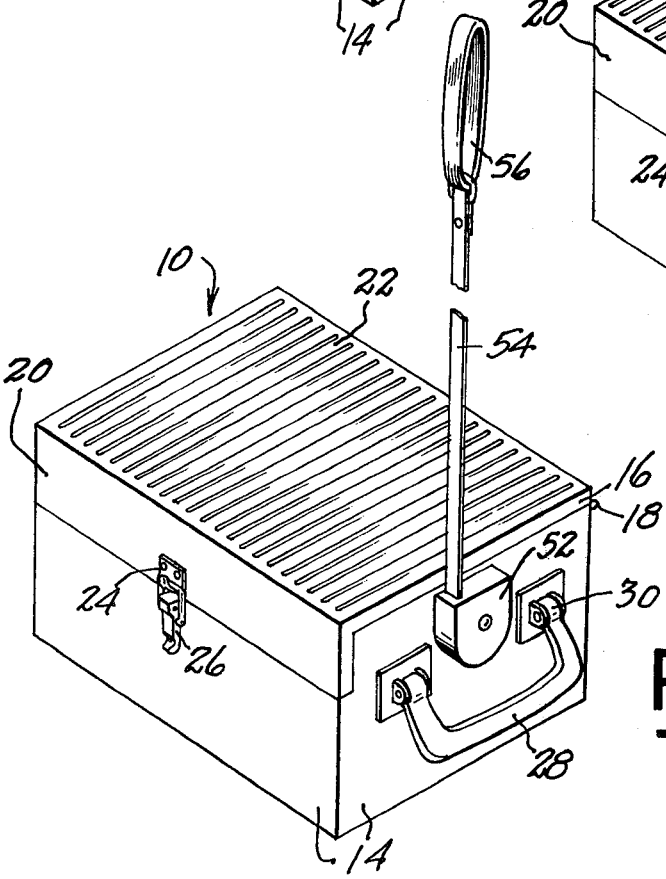
FIG. 7 is a perspective view of a third embodiment of the invention.

Another embodiment of the invention is illustrated in FIG. 7, wherein parts similar to those shown in FIGS. 1–5 bear the same reference numerals as those used in FIGS. 1–5. In this instance the case will also preferably be provided with a handle. One side wall 14 of the case, preferably adjacent the top thereof when the case rests upon its bottom panel, mounts, at a position preferably substantially equally spaced between its ends, a housing 52 for an extensible flexible metal tape 54. The housing 52 and the tape 54 are of a construction comparable to that conventionally employed in coiled extensible-retractible metal measuring tapes wherein the metal tape has a slight transverse curvature throughout its length so as to remain substantially straight when extended and wherein the tape is coiled as guided by the interior curvature of the housing 52 when the tape is urged endwise into that housing. The tape will be provided with suitable stop means to resist complete withdrawal or release of the tape from the housing 52, and will preferably be provided with hand grip means, such as a loop 56, at the free end thereof to provide a handle facilitating convenient gripping of the tape when in its extended position, while a user mounts the case and dismounts therefrom while the case is used as a step. The handle 56 also accommodates ready, simple and easy pull on the tape to extend it and may be used to assist in retracting the tape into the housing 52. If desired, the hand loop 56 may be pivoted to the free end of the tape 54.

While the preferred embodiments of the invention has been illustrated and described, it will be understood that changes in the construction may be made within the scope of the appended claims without departing from the spirit of the invention.

What I claim is:

1. An article of manufacture comprising an article carrying case having side panels and water resistant top and bottom panels and of rigid construction to support the weight of a person standing thereon, said top panel also having a tread surface to prevent inadvertant slipping of said person when standing on said top panel, said top panel being pivoted to a side panel and releasably locked in operating position, a hand grip mounted on a side panel, and an extensible member adjustably carried by said grip-mounted side panel and having an extended position accommodating grasping thereof by said person while standing on said carrying case and descending or ascending from and climbing to a level above the top of the case and a second retracted position accommodating convenient transport of said carrying case from place to place, wherein said extensible member is an elongated flexible strap having means anchoring the ends thereof to said grip mounting side panel, at least one of said end anchoring means being releasable from said grip-mounted side panel, and the released end of said strap being grasped during said descending or ascending of said person so that said case may be retrieved when said person is no longer standing on said case.

2. An article of manufacture as defined in claim 1, wherein the end of said strap associated with said releasable anchoring means includes a loop defining part.

* * * * *